US005462006A

United States Patent [19]

Thiruppathi

[11] Patent Number: 5,462,006

[45] Date of Patent: Oct. 31, 1995

[54] BOOKMARK

[76] Inventor: Devaraj Thiruppathi, 4825 Beverly Ave., NE., Canton, Ohio 44714

[21] Appl. No.: 348,714

[22] Filed: Dec. 2, 1994

Related U.S. Application Data

[63] Continuation-in-part of Ser. No. 251,975, Jun. 1, 1994, abandoned, and a continuation-in-part of Ser. No. 209,079, Mar. 11, 1994, abandoned.

[51] Int. Cl.[6] ..... B42D 9/00

[52] U.S. Cl. ..... 116/234; 281/42

[58] Field of Search ..... 116/234, 235, 116/236, 237, 238, 239, 240; 40/158.1; D19/34; 239/34; 281/42

[56] References Cited

U.S. PATENT DOCUMENTS

| | | | |
|---|---|---|---|
| D. 311,209 | 10/1990 | Svee | D19/34 |
| D. 313,627 | 1/1991 | Diaz | D19/34 |
| 2,282,939 | 5/1942 | Clawson | 40/158 |
| 3,837,987 | 9/1974 | Williams et al. | 40/159 X |
| 4,465,232 | 8/1984 | Field | 239/36 |
| 4,944,968 | 7/1990 | Wagner | 40/159 X |
| 4,984,529 | 1/1991 | Dickson | 116/234 |
| 4,990,381 | 2/1991 | Holzner . | |
| 5,249,827 | 10/1993 | Olson | 283/36 |
| 5,375,351 | 12/1994 | King et al. | 40/124.1 |

*Primary Examiner*—William A. Cuchlinski, Jr.
*Assistant Examiner*—Willie Morris Worth
*Attorney, Agent, or Firm*—Sand & Sebolt

[57] ABSTRACT

A bookmark has a rear plate and a front plate secured by an adhesive in juxtaposition to the rear plate. Either one or both of the plates is formed with an opening for receiving either a photograph or a supply of potpourri. The front plate has a planar surface for receiving either a preprinted message or an individualized message placed thereon by the user. In another embodiment, a plurality of openings are provided in the front plate, with one opening communicating with a photograph pocket for viewing a photograph enclosed therein, and a second opening for receiving a supply of potpourri, or chemical fragrance. The potpourri may be interposed between the book pages to mask any odors associated therewith and to provide a pleasing fragrance to the reader upon opening of the book.

17 Claims, 3 Drawing Sheets

BOOKMARK

This application is a continuation-in-part of patent applications Ser. Nos. 08/251,975, filed Jun. 1, 1994 and 08/209,079, filed Mar. 11, 1994, both now abandoned.

BACKGROUND OF THE INVENTION

1. Technical Field

The invention relates to bookmarks. More particularly, the invention relates to personalized bookmarks. Specifically, the invention relates to bookmarks which are aromatic or are formed with a photograph pocket for receiving a photograph.

2. Background Information

Reading has been a popular pastime for many years, and as the number of available books and magazines increases, the popularity of reading as a pastime is expected to increase. In fact, it has been said that there is a book or magazine available for nearly every imaginable topic, interest or hobby. Moreover, knowledge increasingly defines a persons level of success, and as such, individuals frequently engage in self education to increase their marketability.

The number of individuals enrolled in formal classes, at colleges, universities and trade schools is also increasing as the business and professional world continues to demand an increasing number of educated professionals in the work force.

Regardless of whether an individual is reading for professional, scholastic or personal reasons, the individual will normally stop reading prior to a book's conclusion and will return to the book at a later point in time. The user inevitably marks the page where he or she stopped reading so that the user need only open the book to the marked page and begin reading exactly where he or she previously stopped.

Although a significant number of individuals turn down the corner of one page to mark the book, or alternatively merely use a scrap of paper to mark the page, many individuals, and specifically those individuals that are avid readers, purchase bookmarks to fulfill this function. Bookmarks may have a variety of sizes and configurations, but generally are manufactured of thin pliable material, and are significantly longer than they are wide to assure that a portion thereof protrudes from the top of the book in which it is positioned. Bookmarks of this type are generally manufactured of thin pliable material to assure that insertion of the bookmark does not damage the book's spine when placed adjacent thereto.

U.S. Pat. No. 2,282,939 shows a picture holder which can function as a bookmark. The holder of this patent includes a body manufactured of a pair of thin pliable sheets, and a picture frame attached to the body at the top and bottom thereof for receiving a photograph. However, this holder includes end members for attaching the top and bottom of the holder to the edges of the pages of a book and thus must be sized for use with a particular size book to perform satisfactory. The user may personalize the bookmark by placing a photograph of a loved one in the picture frame. While the holder of this patent is presumably adequate for the purpose for which it was intended, inasmuch as it has open sides, it is possible that the enclosed photograph would not stay interposed between the picture frame and the holder body. Moreover, inasmuch as the picture frame increases the width of the bookmark, its use is potentially damaging to the book's spine.

Another problem faced by avid readers, is the odor of paper and glue associated with books, and specifically with books that have remained closed for significant periods of time.

U.S. Pat. No. 4,465,232 discloses an adornment having a pocket formed therein for receiving a scented element, which is preferably a scent saturated pellet or a scent filled capsule. The device of this patent also has an adhesive surface on the back of the adornment for securing to a piece of cloth or paper. While the device of this patent is presumably adequate for the purpose for which it is intended, it is not a bookmark, and when applied thereto, would substantially increase the overall width of the bookmark such that damage to the book's spine would likely result when inserted therein. Moreover, inasmuch as this prior art adornment includes an adhesive back, it itself would not function well as a bookmark as damage may result to the book, and the adornment itself is of a relatively small size.

Therefore, the need exists for a bookmark which may be personalized by securing a photograph therein, and which may include separately or with the photograph a scented section for receiving aromatic liquid or potpourri to mask the odors associated with glue and paper within books and to provide a pleasing fragrance to the reader, such that the photograph and/or aromatic material may be affixed within the bookmark without substantially increasing the bookmark width to assure that use of the bookmark will not unduly damage the spine of the book in which it is placed.

SUMMARY OF THE INVENTION

Objectives of the invention include providing an improved bookmark which is manufactured of a relatively thin flexible material, and which is of sufficient length to assure that a portion of the bookmark extends out of the book.

Another objective of the invention is to provide such an improved bookmark which includes a pocket, closed on three sides, which receives a photograph.

Yet another objective of the invention is to provide such a bookmark which is aromatic.

Still another objective of the invention is to provide a bookmark which includes an opening for receiving aromatic potpourri.

A further objective of the invention is to provide such a bookmark which is aromatic, and which includes a pocket for receiving a photograph.

A still further objective is to provide such a bookmark which includes a planar portion for receiving words or printed artwork below the photograph.

Yet a further objective of the invention is to provide such a bookmark which includes a flexible material which permits air flow therethrough, and which retains the potpourri within the opening.

Another objective of the invention is to provide such a bookmark which is of a simple construction, which achieves the stated objectives in a simple, effective and inexpensive manner, and which solves problems and satisfies needs existing in the art.

These and other objectives and advantages of the invention are obtained by the improved bookmark, the general nature of which may be stated as including front and rear plates; an opening formed in said front plate; and attachment means attaching the front and rear plates in juxtaposition except along the periphery of the front plate opening to form a pocket for receiving a photograph therein and forming a top opening for inserting the photograph into the pocket, wherein the pocket has a cavity formed between said front and rear plates and extending around the periphery of said opening except for said top opening, for receiving edges of the photograph in said cavity to retain said photograph within said pocket.

BRIEF DESCRIPTION OF THE DRAWINGS

Preferred embodiments of the invention, illustrative of the best modes in which the applicant has contemplated applying the principles, are set forth in the following description and are shown in the drawings and are particularly and distinctly pointed out and set forth in the appended claims.

Similar numerals refer to similar parts throughout the drawings.

DESCRIPTION OF THE PREFERRED EMBODIMENTS

Figure 1:
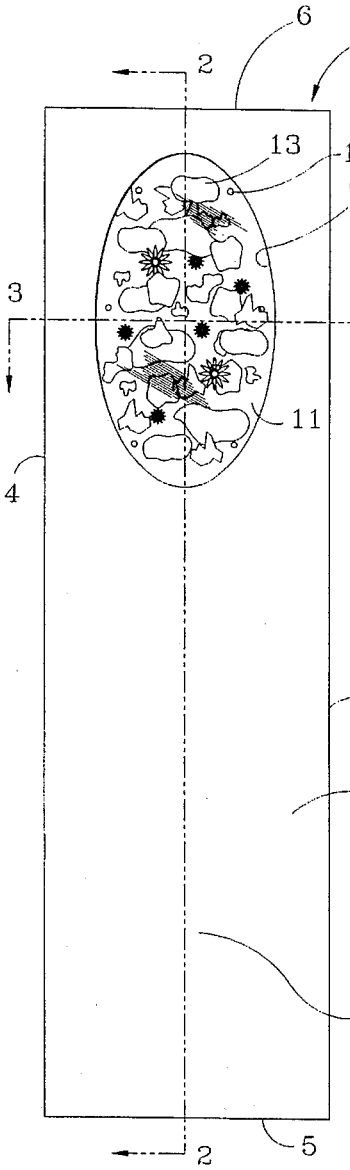
FIG. 1 is a front elevational view of a first embodiment of the bookmark of the present invention.
Figure 2:
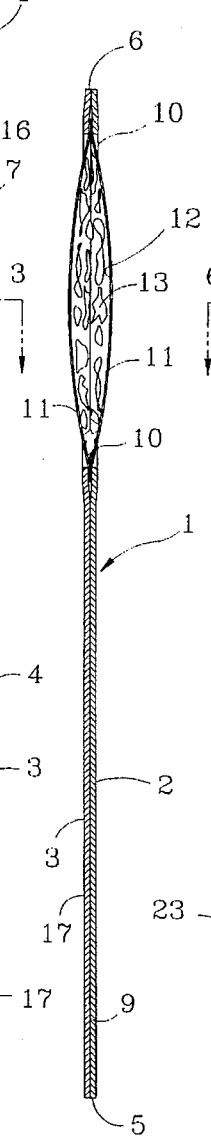
FIG. 2 is a longitudinal sectional view taken along line 2—2, FIG. 1.
Figure 3:
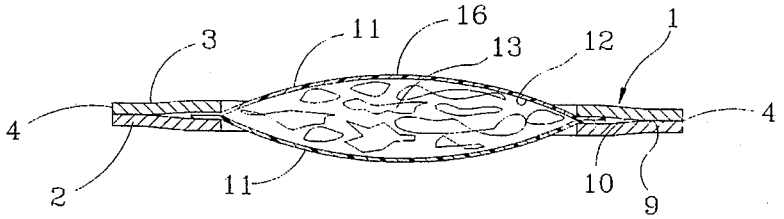
FIG. 3 is an enlarged sectional view taken along line 3—3, FIG. 1.

A first embodiment of the improved bookmark of the present invention is indicated generally at 1, and is shown particularly in FIGS. 1, 2 and 3. Bookmark 1 includes a rear plate 2 and a front plate 3 joined along substantially their entire length. While rear plate 2 and front plate 3 may have a variety of sizes and configurations, in the preferred embodiment they are substantially rectangular, and similar in size and configuration. Rear plate 2 and front plate 3 each include a pair of parallel and spaced apart side edges 4, a bottom edge 5, and a top edge 6. Rear plate 2 and front plate 3 are each formed with an oval-shaped opening 7 which are similar in size and configuration, and similarly positioned on plates 2 and 3. Front plate 3 is in juxtaposition with plate 2 whereby planar contact exists therebetween. An adhesive layer 9 is interposed between plates 2 and 3 to securely fasten together front plate 3 and rear plate 2.

In accordance with one of the main features of the present invention, rear plate 2 and front plate 3 flare slightly outwardly adjacent opening 7 defining a wedge shaped annular cavity 10 (FIG. 3) adjacent opening 7. A flexible plastic sheet 11 extends over each opening 7 and is adhesively secured in wedge shaped annular cavity 10 whereby flexible sheets 11 define a compartment 12. A supply of scented potpourri 13 is retained between flexible sheets 11 within compartment 12. A plurality of small apertures 16 extend through flexible sheets 11 to permit air to pass over potpourri 13 positioned in compartment 12 and be dispersed into the surrounding air. Front plate 3 also includes a planar surface 17 for receiving a message or printed artwork thereon, which could also be printed on rear plate 2. Surface 17 may include a preprinted message, or may be manufactured of a material which permits the user to transcribe a message thereon.

In use, bookmark 1 is positioned intermediate the pages of a book to mark the reader's position. The user may position potpourri 13 outwardly from the book; or alternatively, potpourri 13 may be positioned within the book to mask the odor associated therewith and to provide a pleasing fragrance when the book is opened. Plates 2 and 3 preferably are formed from single plies of cardboard, plastic or similar material.

Figure 4:
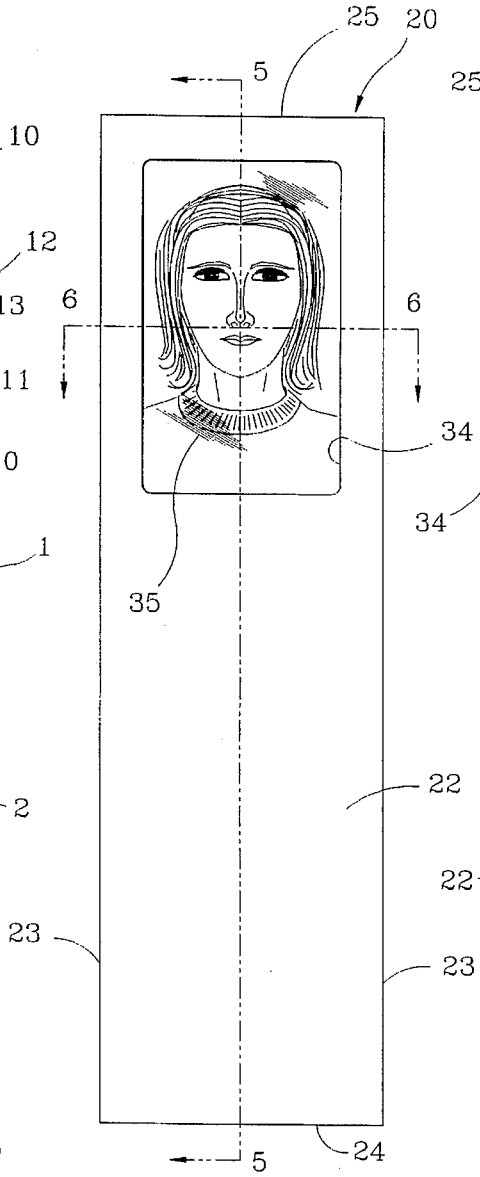
FIG. 4 is a front elevational view of a second embodiment of the bookmark of the present invention.
Figure 5:
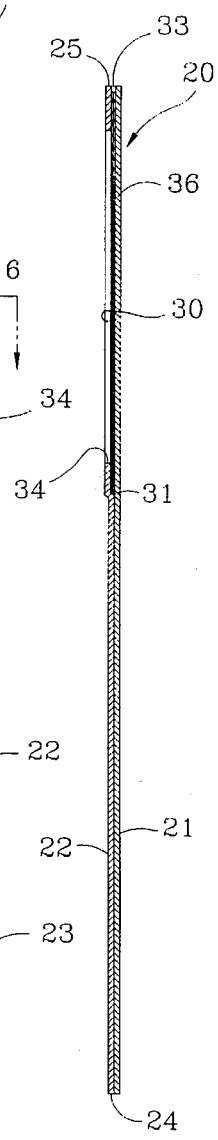
FIG. 5 is a longitudinal sectional view taken along line 5—5, FIG. 4.
Figure 6:
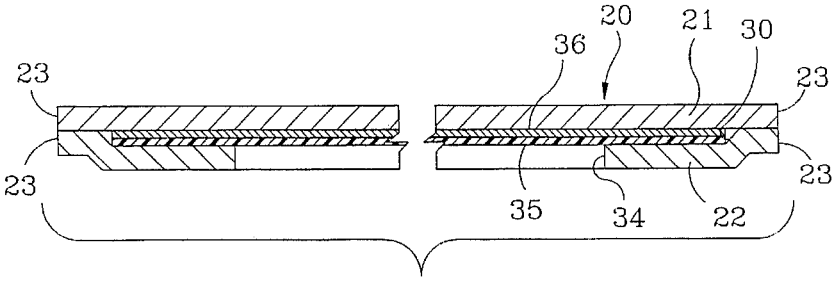
FIG. 6 is an enlarged sectional view taken along line 6—6, FIG. 4.

A second embodiment of the present invention is indicated generally at 20, and is shown particularly in FIGS. 4, 5 and 6. Bookmark 20 includes a rear plate 21 and a front plate 22 similar in size and configuration. Plates 21 and 22 each include a pair of parallel and spaced apart side edges 23, a bottom edge 24, and a top edge 25. Adhesive layer 26 extends between rear plate 21 and front plate 22 for joining plates 21 and 22 in juxtaposition. A photograph pocket 30 and access opening 33 is partially defined by rear plate 21 and front plate 22 and extends therebetween. Adhesive layer 26 defines a bottom wall 31 of photograph pocket 30. Moreover, adhesive layer 26 extends intermediate plates 21 and 22 adjacent the sides of photograph pocket 30 and defines the sides of the pocket. Top edges 25 of plates 21 and 22 are usually not secured together and define opening 33 to provide access into pocket 30. However, if desired, an adhesive strip may be used to seal opening 33 to permanently secure the photograph in pocket 30.

In accordance with one of the main features of the present invention, front plate 22 is formed with a substantially rectangular opening 34 which communicates with photograph pocket 30 to provide visual inspection of the photograph contained therein. Referring specifically to FIG. 6, a transparent plastic sheet 35 extends into photograph pocket 30, and covers opening 34. Preferably, plastic sheet 35 is larger than opening 34 to assure that the same will not inadvertently pass therethrough. A photograph 36 is positioned intermediate plastic sheet 35 and rear plate 21 whereby photograph 36 may be viewed through opening 34 and sheet 35. Front plate 22 flares outwardly at a shoulder to form photograph pocket 30 and provide sufficient space for plastic sheet 35 and photograph 36. Similar to bookmark 1, bookmark 20 also provides a planar surface 37 for receiving a message thereon and preferably is formed of the same single ply cardboard or plastic material as are plates 2 and 3. Such messages and artwork can also be placed on back plate 21.

Adhesive layer 26 extending along the sides and bottom of photograph pocket 30, and in combination with rear plate 21 and front plate 22 form pocket 30 for retaining photograph 36 thereon. Specifically, plates 21 and 22 are rigidly attached along three sides of photograph pocket 30 to prevent photograph 36 from moving within photograph pocket 30. The user may also remove plastic sheet 35 and use it as a template to size photograph 36 for insertion in photograph pocket 30. In this manner, photograph 36 is sized nearly identical to the width of photograph pocket 30, thus preventing the inadvertent removal through access opening 33 formed between top edges 25 of plates 21 and 22.

Figure 7:
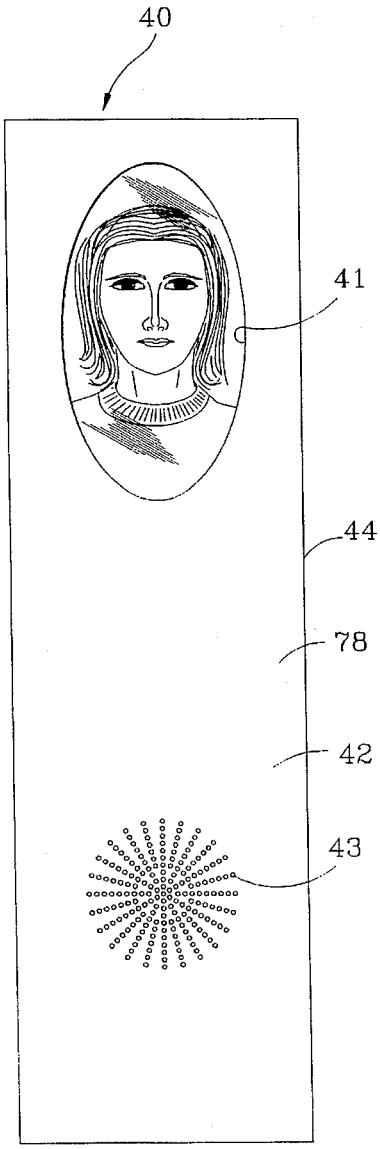
FIG. 7 is a front elevational view similar to FIGS. 1 and 4 of a third embodiment of the bookmark of the present invention.

A third embodiment of the bookmark of the present invention is indicated generally at 40, and is shown particularly in FIG. 7. Bookmark 40 is similar to bookmark 20 with the exception that it includes an oval-shaped opening 41 rather than the substantially rectangular opening 34 of bookmark 20. Bookmark 40 also includes front and rear plates 42 and 44, respectively, secured together in juxtaposition by an adhesive. Front plate 42 and/or rear plate 44 is formed with a plurality of holes 43 extending therethrough. Holes 43 may have a variety of configurations, with the pinwheel design being shown as an exemplary embodiment. The rear plate of the third embodiment of the present invention is treated with a usual chemical fragrance. When front plate 42 and rear plate 44 are bonded together, holes 43 are positioned over the area on the rear plate where the chemical fragrance has been applied to permit air to pass thereover and discharge the pleasing fragrance into the surrounding air.

Holes 43 are positioned between the pages of a book when in closed position on bookmark 40 to allow air to pass over the chemical fragrance applied to the rear plate, and to partially mask the odors associated with glue and paper in books and magazines and to provide a pleasing fragrance to the reader upon opening of the book.

Figure 8:
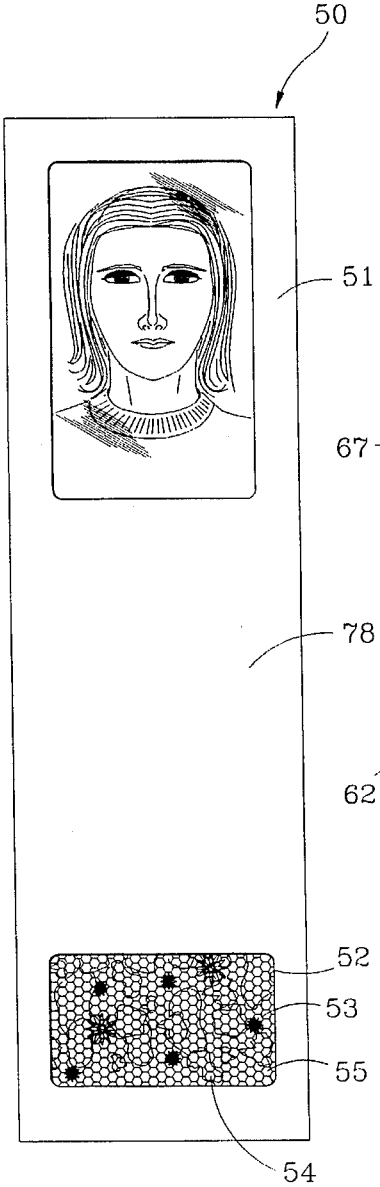
FIG. 8 is a front elevational view similar to FIGS. 1, 4 and 7 of a fourth embodiment of the bookmark of the present invention.

A fourth embodiment of the present invention is indicated generally at 50, and is shown particularly in FIG. 8. Bookmark 50 is similar to bookmark 20, with the exception that bookmark 50 includes a front plate 51 formed with a second opening 52. A flexible mesh 53 is secured between front plate 51 and the rear plate and extends over opening 52. A supply of potpourri 54 is interposed between the rear plate and flexible mesh 53. Mesh 53 has openings 55 to permit air to flow over potpourri 54 and dispense its fragrance into the surrounding air. Again, mesh 53 and potpourri 54 may be positioned intermediate the pages of a book to mask the odors associated therewith and to provide a pleasing aroma to the reader. Mesh 53 can also cover a similar opening formed in the rear plate, independent of or aligned with opening 52.

Figure 9:
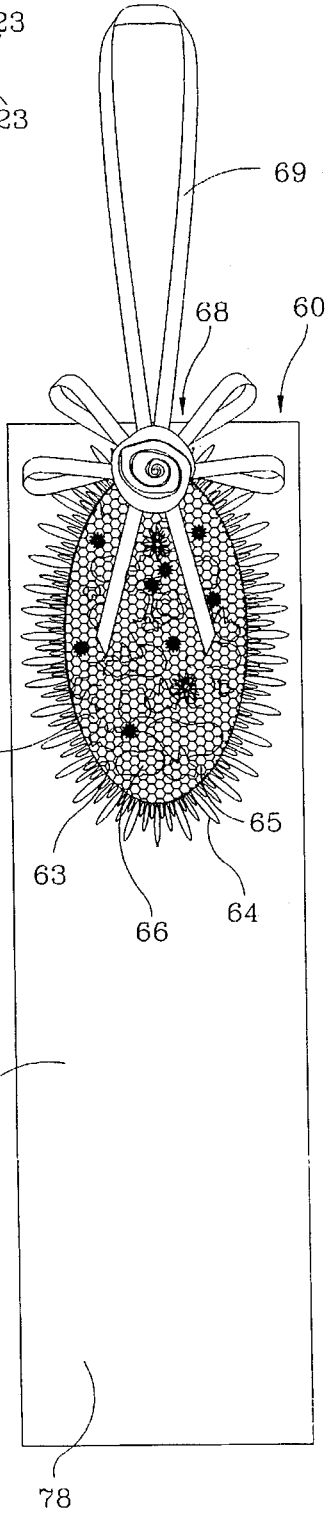
FIG. 9 is a front elevational view similar to FIGS. 1, 4, 7 and 8 of a fifth embodiment of the bookmark of the present invention.

A fifth embodiment of the bookmark of the present invention is indicated generally at 60, and is shown particularly in FIG. 9. Bookmark 60 is similar to bookmark 1 in that it includes a front plate 61 and a rear plate 62. However, while front plate 61 includes an oval-shaped opening 63, rear plate 62 may not include an opening as in the first embodiment of the present invention.

A flexible mesh 65, similar to flexible mesh 53 of bookmark 50, is secured between front plate 62 and the rear plate, and extends over opening 63. Mesh 65 may be secured between the front and rear plates with any convenient attachment means, such as an adhesive. A decorative lace border 64 may extend around the periphery of opening 63 of front plate 62 to increase the attractiveness of bookmark 60.

Again, similar to bookmark 50, a supply of potpourri 66 is interposed between mesh 65 and the rear plate. Mesh 65 is formed with openings 67 to permit air to flow over potpourri 66 for dispensing the pleasing scent into the air.

In accordance with one of the features of bookmark 60, a bow 68 is attached to mesh 65 by any convenient attachment means, such as a clip which extends through one of the openings 67 of mesh 65. Bow 68 includes an upper flexible loop 69, which in addition to being decorative when in use, provides a hanger for bookmark 60 when displayed for sale in a retail establishment.

Figure 10:
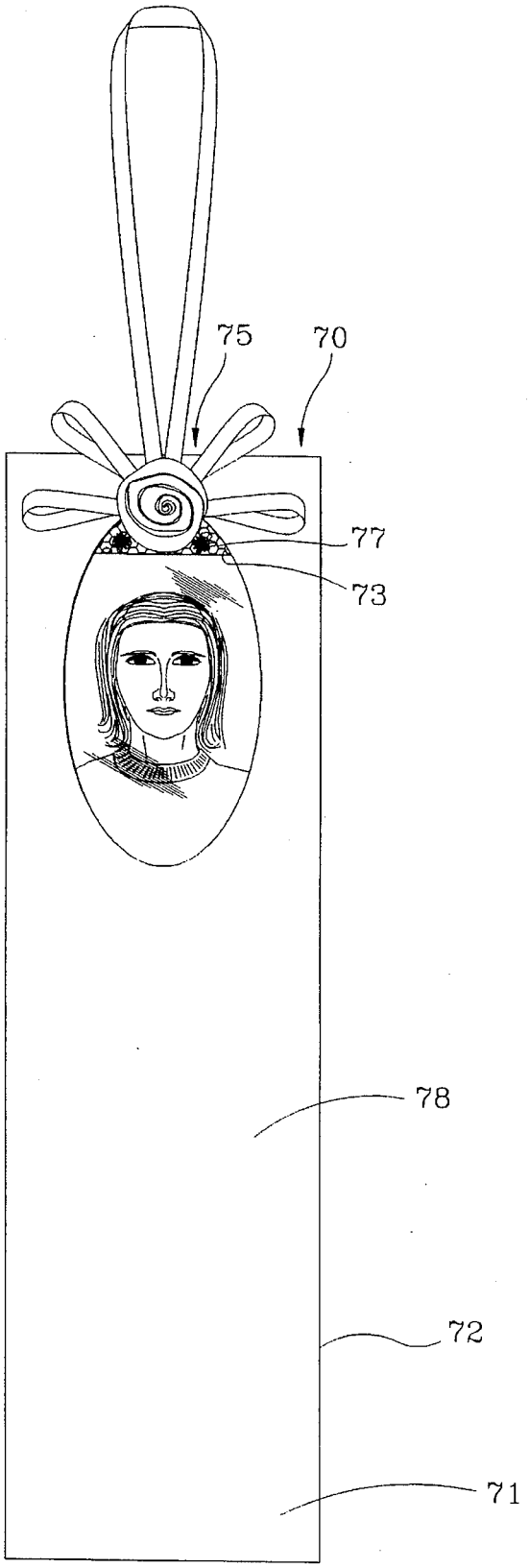
FIG. 10 is a front elevational view similar to FIGS. 1, 4, 7—9 of still another embodiment of the bookmark of the present invention.

Another embodiment of the present invention is indicated generally at 70, and is shown particularly in FIG. 10. Bookmark 70 is similar to bookmark 20 in that it includes front and rear plates 71 and 72 respectively, with a photograph pocket 73 interposed therebetween. Photograph pocket 73 is similar to photograph pocket 30 of bookmark 20, with the exception that an opening 74 which extends through front plate 71 is oval-shaped rather than rectangular. A flexible mesh 77 is interposed between the rear and front plates and extends over a small upper portion of opening 74. A bow 75 similar to that of bookmark 60, is affixed to mesh 77.

As is apparent from FIGS. 7–10, bookmarks 40, 50, 60 and 70 may be provided with a front planar surface 78 which accepts a message or artwork printed thereon. The message applied to planar surface 78 may be preprinted at manufacture or planar surface 78 may be manufactured of a material which permits the user to write a personalized message thereon.

In summary, the bookmarks of the present invention are formed by a rear plate and a front plate secured in juxtaposition to each other by an intervening layer of an adhesive extending therebetween. Either one or both of the front and rear plates is formed with an opening for receiving either a user's photograph or a supply of potpourri. The bookmarks of the present invention also provide a front planar surface for receiving a message, and in a number of embodiments, a plurality of openings are provided in the front plate, with one opening communicating with a photograph pocket for viewing a photograph enclosed therein, and a second opening for receiving a supply of potpourri, or chemical fragrance.

Accordingly, the improved bookmark is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved bookmark is constructed and used, the characteristics of the construction, and the advantageous, new and useful results obtained; the new and useful structures, devices, elements, arrangements, parts and combinations, are set forth in the appended claims.

I claim:

1. A bookmark comprising:

front and rear plates;

an opening formed in said front plate; and attachment means attaching the front and rear plates in juxtaposition except along the periphery of the front plate opening to form a pocket for receiving a photograph therein and forming a top opening for inserting the photograph into the pocket, wherein the pocket has a cavity formed between said front and rear plates and extending around the periphery of said opening except for said top opening, for receiving edges of the photograph in said cavity to retain said photograph within said pocket; fragrance emanating means for emanating a fragrance positioned adjacent the rear plate; and access means for permitting air to flow over the fragrance emanating means.

2. A bookmark as defined in claim 1 in which the attachment means is an adhesive.

3. A bookmark as defined in claim 2 in which a transparent sheet of plastic material is mounted in the photograph pocket and extends over the opening.

4. A bookmark as defined in claim 1 in which the front plate includes a message area for receiving a message.

5. A bookmark as defined in claim 1 in which the fragrance emanating means is a chemical fragrance applied to one of the plates; and in which the access means is a plurality of holes extending through at least one of the plates adjacent the chemical fragrance.

6. A bookmark as defined in claim 1 in which the fragrance emanating means is potpourri; in which a second opening is formed in at least one of the plates for receiving the potpourri; in which a first flexible sheet of material extends over the second opening and over the potpourri housed therein; and in which the access means is a plurality of holes extending through said first flexible sheet of material.

7. A bookmark as defined in claim 6 in which the flexible material is a plastic sheet.

8. A bookmark as defined in claim 6 in which the flexible sheet of material is a mesh.

9. A bookmark as defined in claim 6 in which the potpourri is interposed between the flexible sheet of material and one of the rear and front plates.

10. A bookmark as defined in claim 6 in which the rear plate is formed with a third opening substantially aligned with the second opening; in which a second flexible sheet of material extends over said third opening and is interposed between the plates; in which the potpourri is positioned intermediate the flexible sheets of material; and in which the access means is a plurality of holes formed in at least one of said flexible sheets.

11. A bookmark as defined in claim 6 further comprising a hanger and attachment means for attaching the hanger to the front plate adjacent a top edge thereof.

12. A bookmark as defined in claim 11 in which the hanger is a decorative flexible bow.

13. A bookmark comprising:

a rear plate;

a front plate secured in juxtaposition on said rear plate and formed with an opening;

a fragrance emanating material located in said opening;

a flexible sheet secured between the front and rear plates and extending over the opening;

attachment means for attaching the flexible sheet intermediate the front plate and the rear plate; and access means for permitting air to flow over the fragrance emanating material.

14. A bookmark as defined in claim 13 in which the fragrance emanating material is potpourri; and in which the access means is a plurality of holes extending through the flexible sheet.

15. A bookmark as defined in claim 14 in which the rear plate includes a second opening aligned with the first opening; in which a second flexible sheet extends over the second opening and is interposed between the plates; in which the potpourri is positioned between the first and second flexible sheets; and in which the access means is a plurality of holes formed in at least one of the flexible sheets.

16. A bookmark as defined in claim 14 in which one of the front and back plate includes a message area for receiving a message.

17. A bookmark comprising:

a rear plate having a top edge and a bottom edge;

a front plate in juxtaposition with the rear plate and having a top edge;

the front plate and the rear plate defining a pocket therebetween for receiving a personalized object;

the pocket having a pair of sides and a bottom;

attachment means for attaching the front plate to the rear plate adjacent the sides and the bottom;

the front plate formed with an opening intermediate the top and the bottom and in communication with the pocket;

a covering extending over the opening and intermediate the front and rear plate for retaining the personalized object; fragrance emanating means for emanating a fragrance positioned adjacent the rear plate; and access means for permitting air to flow over the fragrance emanating means.

* * * * *